United States Patent [19]

Borst

[11] Patent Number: 4,602,719

[45] Date of Patent: Jul. 29, 1986

[54] RECLOSABLE PLASTIC CONTAINER HAVING IMPROVED OPENING RELEASE

[75] Inventor: Rodney D. Borst, Oregon, Wis.

[73] Assignee: Placon Corporation, Madison, Wis.

[21] Appl. No.: 784,783

[22] Filed: Oct. 3, 1985

[51] Int. Cl.[4] ..... B65D 43/26

[52] U.S. Cl. ..... 220/263; 220/260; 220/339

[58] Field of Search ..... 220/260, 352, 263, 353, 220/264, 339, 315; 229/2.5 R, 44 R

[56] References Cited

U.S. PATENT DOCUMENTS

| | | | |
|---|---|---|---|
| 3,082,903 | 3/1963 | Stevens et al. . | |
| 3,397,774 | 8/1968 | Tjaden . | |
| 3,670,952 | 6/1972 | Venuti et al. . | |
| 3,942,707 | 3/1976 | Schidlowski et al. . | |
| 4,096,986 | 6/1978 | Florian . | |
| 4,202,464 | 5/1980 | Mohs et al. . | |
| 4,312,451 | 1/1982 | Forbes, Jr. . | |
| 4,363,403 | 12/1982 | Raucci, Jr. et al. | 220/339 |
| 4,454,958 | 6/1984 | Juillet et al. | 220/339 |

OTHER PUBLICATIONS

Exhibit 1 constitutes photographs of a product representative of prior art reclosable containers having overlapping flanges at the front of the container which are intended to be used to aid in separating the cover from the base of the container.

*Primary Examiner*—George T. Hall

*Attorney, Agent, or Firm*—Isaksen, Lathrop, Esch, Hart & Clark

[57] ABSTRACT

A reclosable plastic container is formed having a cover hingedly attached to a base and having an interlocking structure such that the cover is held on the base when the container is closed. Release tabs are formed on each of the cover and base adjacent one another and having camming surfaces on each tab which extend therefrom toward the other tab. The camming surfaces on the tabs intersect in a fulcrum such that when the user presses the tabs together, the tabs rotate about the fulcrum to pull the cover and base apart. The camming surface on each tab may be formed as a ridge formed integrally with the tab. Reinforcing ridges, extending away from the plane of the tab in a direction opposite to that of the camming surfaces, are also preferably formed in the tab to provide structural rigidity so that the tabs do not substantially bend or flex when they are pressed by the user. The tabs allow a securely closed container to be easily opened by one hand of the user.

33 Claims, 8 Drawing Figures

RECLOSABLE PLASTIC CONTAINER HAVING IMPROVED OPENING RELEASE

FIELD OF THE INVENTION

This invention pertains generally to the field of packaging and containers, and particularly to plastic containers of the type having closable tops or lids which are intended to be repeatedly closed and reopened.

BACKGROUND ART

A variety of products are now commonly packaged in reclosable plastic containers with the expectation that the consumer will retain the container for a period of time to store the purchased articles. Consequently, such containers must be capable of withstanding a reasonable number of cycles of opening and closing during the expected period of use of the articles. The functioning of the container, particularly the ease by which the container may be closed and reopened, thus becomes an important factor in total consumer satisfaction.

A typical plastic container intended to hold merchandise at the point of sale has a bottom portion or base and a top lid or cover attached to the base by a hinge. Although rectangular packages are most common, the base and cover may have a variety of configurations, including polygonal, round, oblong, etc. To hold the cover to the base when the cover is closed, it is very common to provide some means for interlocking the cover and base. One type of interlocking structure is obtained by providing an upstanding shoulder about the periphery of the base which has an outwardly extending, overhanging lip. The cover has a depending wall portion with an indentation therein adapted to mate with the lip on the base so that, when the cover is pressed to the base, the indentation and lip engage with each other in a "snap" fit. The engagement between the lip and indentation holds the cover and base together during normal handling, but allows them to be parted when sufficient force pulling them apart is exerted.

For many containers having a secure snap fit closure, it may be very difficult or inconvenient for the user to reopen the container simply by grabbing the two halfs and pulling them apart. For example, the base and cover portions may not be readily grasped by the hands of the user; the base and cover may be too large or too small or too slippery or in a shape which is difficult to hold. Under some circumstances, it may be desirable or even necessary that the user be able to open the container using only one hand, such as where the container is intended to be used by the elderly or disabled. Consequently, many of the presently available reclosable containers have some feature formed on them specifically intended to aid the user in reopening the container. For example, it is common for containers to be provided with flanges which extend outwardly from the peripheries of the base and cover portions; usually, the flanges are formed adjacent to one another but do not entirely overlap. The user then may pull the flange portions on the cover and base away from each other with his fingers to draw the cover and base apart. The finger manipulation required to pull such flanges apart can present problems to some users, such as those afflicted with arthritis. In addition, many containers have snap fit interlocks at more than one position on the containers, such as each of the two free (unhinged) corners of a rectangular container, such that two sets of opening aid flanges must be provided with one set of flanges adjacent to each of the interlocking positions. The opening force applied at the position of one of the interlocks may not sufficiently part the cover and base to release the interlock which is not adjacent, thus requiring that the user use both hands to open the container at the two sets of flanges.

SUMMARY OF THE INVENTION

A reclosable container in accordance with the present invention has a base with peripheral edges, a cover with peripheral edges hingedly attached along one edge to the base to close upon and cover the same, and release tabs formed on the peripheral edges of the base and cover, respectively, which are adjacent to each other when the cover is closed on the base. Each of the tabs has camming means formed thereon which engage when the cover is closed on the base to force the tabs away from one another. In particular, such means can take the form of camming surfaces formed integrally with each tab such that the camming surfaces extend from each tab toward each other and engage when the cover is closed on the base. The user then grasps the two adjacent tabs and presses them together with the fingers of one hand—a relatively simply and easy manipulation—causing the tabs to rotate about the fulcrum formed at the line of engagement between the camming surfaces on the two tabs, and thereby driving apart the cover and base at the tabs.

The lever action resulting as the tabs rotate about the fulcrum line allows a very substantial separation force to be exerted between the cover and base. This mechanical advantage obtained by this lever action is a function of the relative length between the fulcrum position on the camming surface and the joint at which the tabs are attached to the cover and base. Because of the mechanical advantage obtained by using these release tabs, an individual can readily reopen even a tightly fitted container using only one hand and with relatively little effort, a matter of particular significant to those individuals who have restricted use of their hands.

In a preferred embodiment, the tabs on the cover and base are formed with an upraised reinforcing ridge extending a substantial portion of the width of each tab to provide reinforcement for the tab. The camming surface in each tab is integrally formed as a ridge in the plastic of the tab which extends from the plane of the tab toward the other tab. The camming surface ridges on the cover tab and base tab, respectively, extend toward each other so that they will meet and engage when the cover is closed on the base. One of the tabs may be connected to the periphery of one of the base or cover at a line of weakness which forms a hinge. Preferably, the base tab is connected by such a hinge to the periphery of the base. When the cover is closed on the base and the raised ridge camming surfaces engage, the tab on the base will be pushed downwardly about its hinge line away from the tab on the cover, allowing the cover and base to be tightly closed without interference by the tabs. The raised truss ridges in the tab serve to reinforce the tabs so that they will not substantially deform when being pressed by the user. In particular, it is preferred that the truss ridges surround the camming surfaces on at least three sides and cover a substantial portion of the tab, extending to or near to the joint between the tab and the peripheral edge of the adjacent base or cover. Such reinforcing structure in the tabs minimizes the flexure of the tabs as they are pressed.

It is further preferred that the release tabs be located on the peripheral edges of the cover and base in proximity to or coinciding with the means by which the cover and base interlock—for example, a snap-fitting overhanging lip on the base and a mating indentation on a depending side wall of the cover. Such interlocking means may desirably be located at the corners of a container having a rectangular periphery, with the releasing tabs similarly located at the corners, either along one peripheral edge adjacent to the corner or spanning the corner on a diagonal.

Further objects, features, and advantages of the invention will be apparent from the following detailed description when taken in conjunction with the accompanying drawings.

DESCRIPTION OF THE PREFERRED EMBODIMENT

Figure 1:
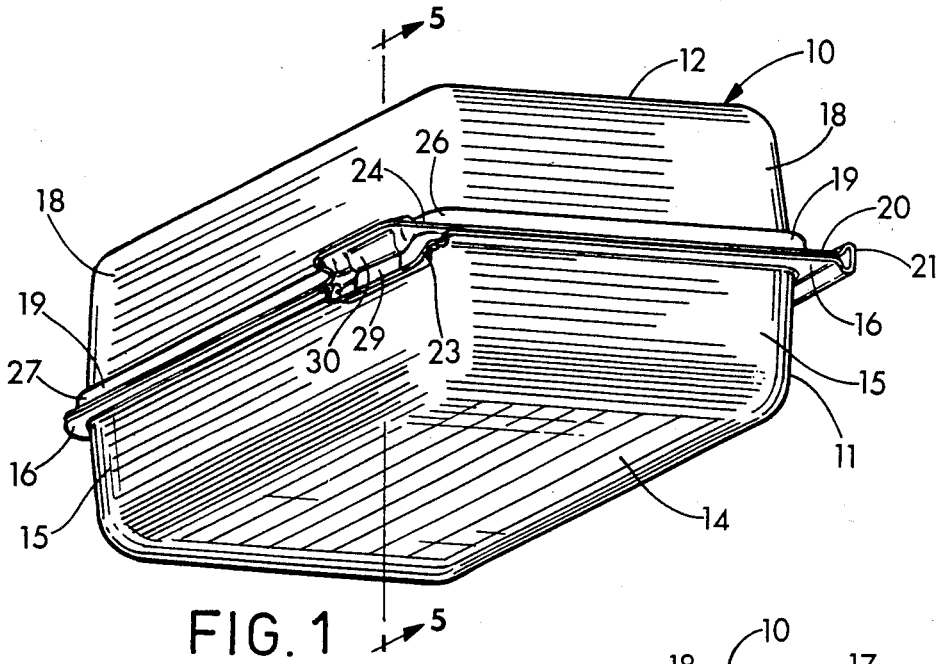
FIG. 1 is a perspective view of a reclosable container having the improved release feature of the invention taken looking up at the container.

With reference to the drawings, a reclosable container embodying the present invention is shown generally at 10 in FIG. 1. The container 10 is shown, for illustrative purposes, as having a substantially rectangularly shaped base 11 and a rectangularly shaped cover 12 which fits over and closes the open top of the base 11. Although the base and cover may have any desired configuration, for example, round, oblong, rectangular or polygonal, etc., the rectangular configuration shown in FIG. 1 is particularly common. In this configuration, the base 11 has a flat bottom wall 14 and four upright side walls 15 which are integrally connected to the bottom wall 14 and to each other. A flange 16 extends outwardly from each of the sidewalls 15. Similarly, the cover 12 has a top wall 17 (not shown in FIG. 1) and four side walls 18 integrally connected to the top wall and to each other. A downwardly depending skirt wall 19 is formed at the bottom of the side walls 18 and is spaced outwardly from the main portion of the side walls, preferably entirely surrounding the periphery of the cover. A flange 20 extends outwardly from the bottom edges of the skirt wall 19 around its outer periphery. An integral hinge 21 joins the base flange 16 and the cover flange 20 along one of the peripheral edges of the flanges and allows the cover to be opened and closed about the base.

The foregoing describes structures typical of reclosable plastic containers although, as noted above, the shape of the container may be other than the rectangular shape shown. Similarly, the cover or the base may effectively constitute a flat or substantially flat wall which has no substantial holding capacity.

In accordance with the present invention, a release tab 23 is provided on the base 11 extending from one peripheral edge thereof and a corresponding release tab 24 is formed on the cover 12 extending from a peripheral edge thereof in a position adjacent to the tab 23 when the cover is closed on the base. While not visible in the view of the closed container in FIG. 1, the cover 12 preferably has a structure thereon which allows it to interlock in a snap fit with the top of the base 11. Generally, the interlocking of the base and cover preferably occurs at the free corners 26 and 27 of the container. The release tabs 23 and 24 are preferably located adjacent to the position of the interlock between the base and cover. One set of tabs 23 and 24 are shown in FIG. 1 adjacent to the one free corner 26, which may be sufficient to allow a release of the container since once one corner is popped open, the user can usually pry the separated base 11 and cover 12 away from one another and break the interlock at the other corner 27. Alternatively, additional release tabs similar to the tabs 23 and 24 may be positioned adjacent to the other corner 27.

The base release tab 23 has a camming surface 29 formed therein which extends upwardly from the general plane of the tab 23. Similarly, the cover release tab 24 has a camming surface 30 formed therein which extends downwardly from the plane of the tab 24 to engage the camming surface 29 when the cover is closed on the base. The camming surfaces 29 and 30 are preferably formed as ridges that extend along the part of the width of each of the tabs and lie generally parallel to the joint between each tab and the base or cover. As illustrated in FIGS. 1–5, the camming surfaces may have a semi-cylindrical shape, with the cylindrical camming surface on one tab (e.g., on the base tab) having a smaller diameter than the camming surface on the other tab.

The base tab 23 has a reinforcing ridge 32 formed therein which extends downwardly from the plane of the tab 23 along a substantial portion of the width of the tab over an area of the tab lying primarily outwardly from the raised camming surface 29. The ridge 32 provides a rigid, reinforced structure for the tab 23 so that it will resist bending under pressure. The tab 23 is preferably attached to an outer peripheral edge of the base 11, for example, the outer peripheral edge of the flange 16, at a flexible hinge 33. The hinge 33 may integrally connect the tab 23 to the flange 16 and be formed as a line of weakness, for example, by being formed of plastic material which is thinner than the plastic of the adjacent portions of the base 11 and the tab 23. In addition, the material of the hinge 33 may be formed into a wrinkle as shown to increase the flexibility of the hinge.

The release tab 24 also preferably has a raised reinforcing ridge 35 which extends over a substantial portion of the width of the tab 24 and extends upwardly away from the plane of the tab, providing reinforcement to the structure of the tab so that it resists bending under pressure. Although the tab 24 may be connected to the cover 17 by a hinge line, it is not necessary that it be so connected, and preferably the tab 24 is attached integrally and rigidly to a peripheral edge of the cover at a joint 36 so that it remains in substantially the same plane as the flange 20.

Figure 2:
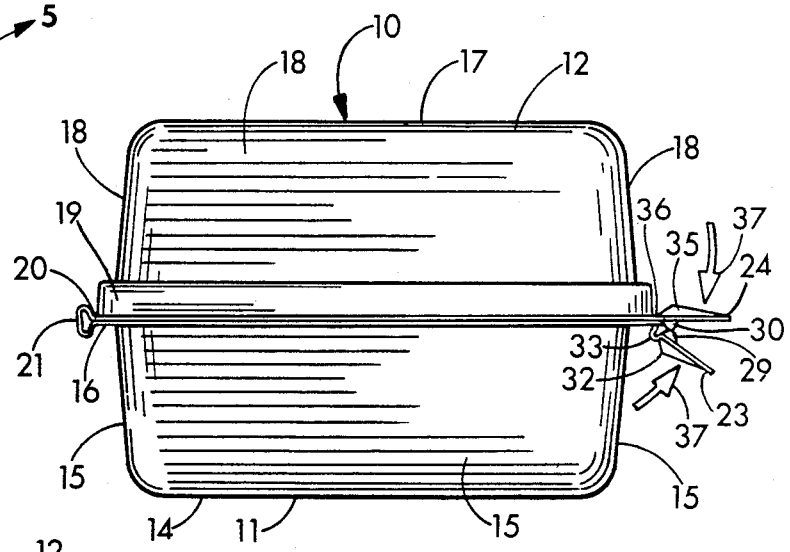
FIG. 2 is a side elevation view of the container of FIG. 1 in closed position, showing the normal spacing of the release tabs.
Figure 3:
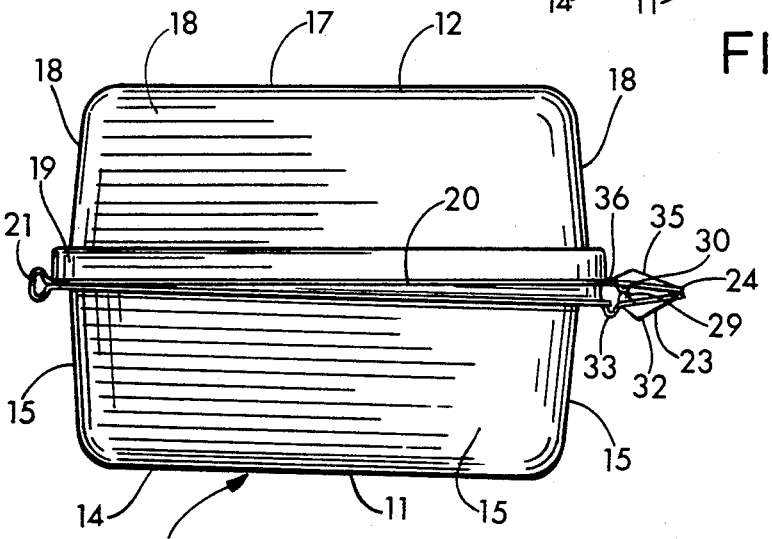
FIG. 3 is a side elevation view of the container as in FIG. 2 with the release tabs pressed toward one another to cause separation of the cover and base.
Figure 4:
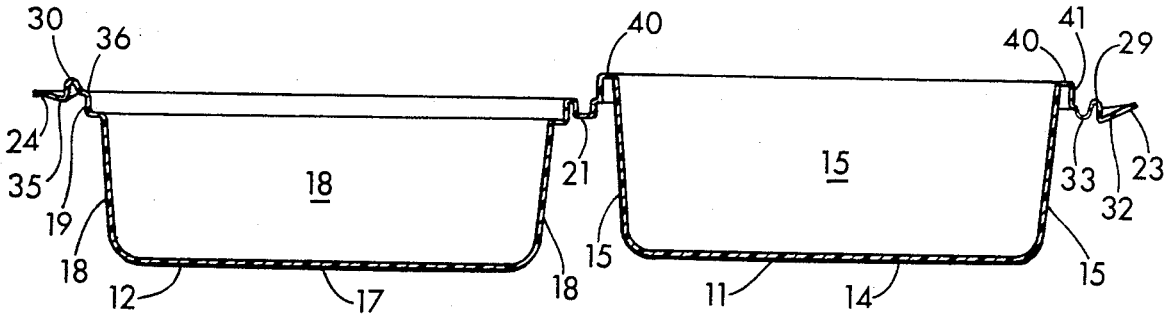
FIG. 4 is a cross-sectional view of the cover of FIG. 1 in its open position taken through substantially the center of the release tabs.

The operation of the release tabs 23 and 24 is best illustrated with respect to the side elevation views of FIGS. 2 and 3. The container 10 is shown in closed position in FIG. 2 with the arrows 37 indicating the direction of the resultant force that would be applied to the tabs by the fingers of a user. This force is applied at positions spaced outwardly from the line at which the camming surfaces 29 and 30 intersect. The intersection of the camming surfaces 29 and 30 thus acts as a fulcrum about which the tabs 23 and 24 pivot, drawing the hinge 33 at which the tab 23 and base 11 intersect away from the intersection 36 between the tab 24 and the cover 12. If the fulcrum defined by the intersection between the camming surfaces 29 and 30 is closer to the joints 33 and 36 than to the position at which the force is applied by the user to the tabs 23 and 24, a significant leverage advantage is achieved and the joints 33 and 36 are pulled apart with a greater effective force than the force applied by the user's fingers. The relative distance between the fulcrum and the joints 33 and 36 with respect to the portions of the tabs 23 and 24 which extend outwardly beyond the fulcrum can be chosen to yield the force that is needed to release the interlocking mechanism at a selected minimum finger pressure.

Figure 5:
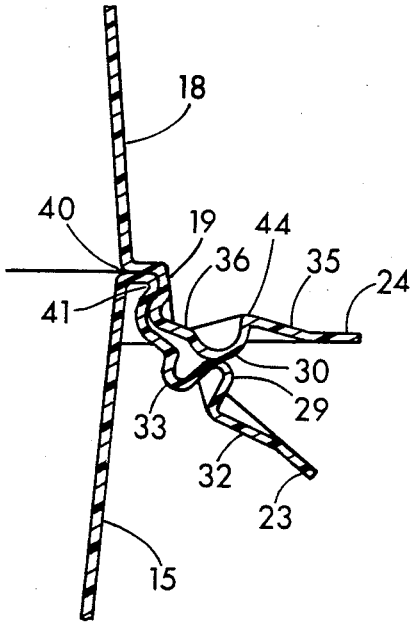
FIG. 5 is a cross-sectional view through a portion of the container of FIG. 1 at the position of the release tabs when the container is in its closed position, taken generally along the lines 5—5 of FIG. 1.

As an example of an interlocking means which may be utilized with the release tabs of the invention, reference is made to FIG. 5—a cross section through the closed container at the position of the tabs—in which the base has a shoulder 40 extending outwardly from the tops of the side walls 15 and a downwardly depending wall 41 with a lip formed therein which mates with a corresponding indentation formed in the downwardly depending wall 19. Generally, the structure which provides the interlocking engagement of the cover and the base, such as the mating lip 41 and indentation in the wall 19, will be formed at or proximate to the tabs 23 and 24 so that the tabs can provide the maximum possible separation force to the interlocking parts.

Figure 6:
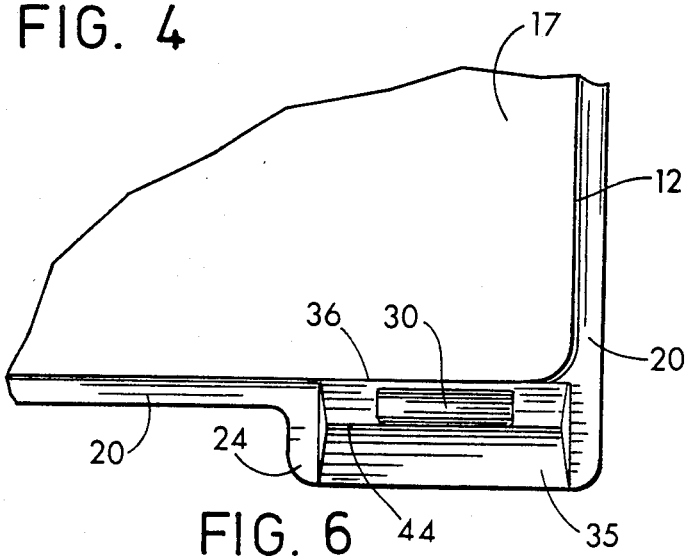
FIG. 6 is a top elevation view of a portion of the cover of the container of FIG. 1 showing the release tab thereon which extends from the container cover.

The reinforcing ridge 35 extends above the level of the intersection line 36 at which the tab 24 is joined to the cover 12 and, as illustrated in FIG. 6, substantially surrounds the area of the camming surface 30, which itself extends downwardly from the level of the joint line 36. The reinforcing ridge 35 may be formed with a substantially triangular cross-section, having a peak line 44 at the apex of the triangle. The reinforcing ridge 35 serves to act as a truss to rigidify the tab 24, enhancing the resistance of the tab to bending either along its width or from the joint line 36 to the outer edge of the tab as the user's finger is pressed on the tab. It is preferred that the raised reinforcing ridge 35 substantially surround the camming surface 30 on three sides so that the tab is reinforced against bending all the way from the outer edge of the tab to the joint 36, although a substantially flat tab may be used where appropriate, such as where the gauge of the plastic sheet material forming the tab is sufficiently heavy to resist excessive bending.

The tab 23 extending from the base is also preferably formed in the same way as described above for the tab 24 so that it too is reinforced against bending either along its width or between the hinge 33 and the outer edge of the tab.

Figure 7:
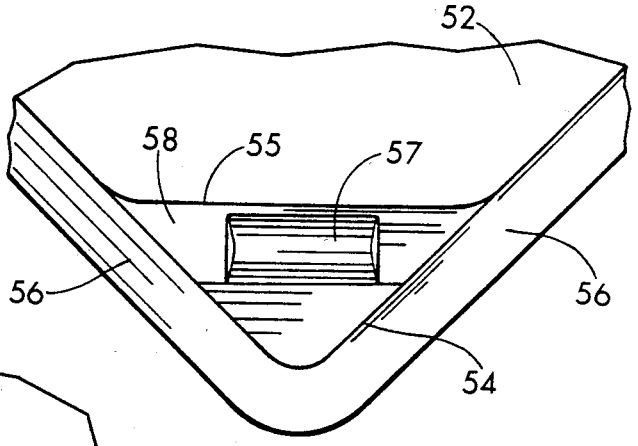
FIG. 7 is a top plan view of a portion of another embodiment of a container of the invention having release tabs located at and spanning diagonally across a corner of the container.
Figure 8:
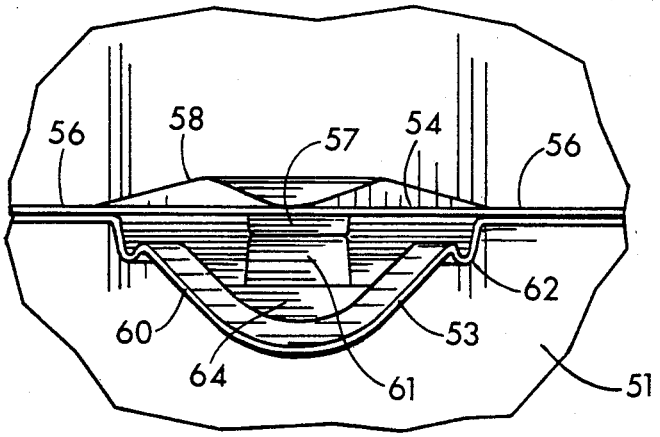
FIG. 8 is an elevation view looking directly at the release tabs at the corner of the container of FIG. 7.

The release tabs in accordance with the invention may be located at any desired position on the cover and base. For example, it is common in rectangular and polygonal containers to have the interlocking structure provided at a corner or corners of the container, sometimes formed on a diagonal indentation in the cover and base portion of the container. The release tabs of the present invention may similarly be located at the corners at the position of the interlocking means, as illustrated in FIGS. 7 and 8, wherein a container base 51 and cover 52 have a base release tab 53 and a cover release tab 54 extending diagonally across a corner of the container. The construction of the container having the base 51 and the cover 52 may otherwise be identical to the construction of the container 10. The release tab 54 extends outwardly from a joint line 55 which extends diagonally across the corner of the cover 52 and defines the line of engagement between the release tab 54 and the periphery of the cover 52. The tab 54 also has a flat flange portion 56 which is joined with a flange which extends continuously around the periphery of the cover 52. A camming surface 57 is formed in the tab and extends downwardly from the level of the joint 55, generally having a semi-cylindrical shape. A raised reinforcing ridge 58 of triangular cross-section extends across the tab 54 between the two sides of the flange 56 to reinforce the tab 54 against bending along the width of the tab or between the joint line 55 and the outer tip of the tab. Again, it is preferred that the raised ridge 58 substantially surround the camming surface 57 on three sides thereof to provide maximum reinforcement for the tab.

The base release tab 53 is formed in a similar manner, having a flat outer flange 60, an upwardly extending semi-cylindrical camming surface 61, and a hinge 62 at which the tab is joined to the base 51. The tab 53 also has a raised reinforcing ridge 64 which extends downwardly below the level of the joint hinge 62 and substantially surrounds the camming surface 61 to reinforce the tab 53 against bending either laterally or between the hinge 62 and the outer tip of the tab. Although not shown, interlocking of any desired type, such as the extending lip and indentation interlocking structure shown in FIG. 5, may be utilized to interlock the cover 52 and the base 51 at the corner of the container at or proximate to the joint 55 and hinge joint 62 by which the tabs 54 and 53, respectively, are joined to the cover and base.

Although the camming surfaces for the release tabs may be formed in the semi-cylindrical shapes best illustrated in FIG. 5, it is also possible for the camming surfaces to have other forms. For example, the camming surface 29 may be a flat surface at the top of a ridge with the camming surface 30 have a semi-cylindrical shape which would roll on the flat camming surface. Other shapes for the camming surfaces, such as a triangular ridge on one tab engaging with a flat surface on the other tab, may also be utilized. It is understood that any camming surfaces which engage at a fulcrum position to apply lever force to the joints between the release tabs and the cover and base are within the scope and concept of the invention.

Although the invention may be utilized with a variety of materials commonly utilized to form containers, it is particularly adapted to containers made of plastics which can be thermoformed from a one-piece sheet of plastic stock material. Suitable initial plastic stocks include high impact polystyrene, polyester, polyvinyl chloride, acrylonitrile butyl styrene (ABS) and acrylic copolymers. Typical sheet thicknesses for plastic containers may be utilized in accordance with the invention, for example, in the 20 to 50 thousandths of an inch range.

It is understood that the invention is not confined to the particular construction and arrangement herein illustrated and described, but embraces such modified forms thereof as come within the scope of the following claims.

What is claimed is:

1. A reclosable container comprising:
(a) a base having peripheral edges;
(b) a cover having peripheral edges and adapted to close upon and cover the base;
(c) a release tab extending from a peripheral edge of the base and having a camming surface formed therein;
(d) a release tab extending from a peripheral edge of the cover and having a camming surface formed therein, the tabs on the cover and base positioned and the camming surfaces on the tabs formed such that when the cover is in closed position on the base, the camming surfaces engage one another and such that, when the tabs are pressed toward each other, the tabs rotate about the position of intersection of the camming surfaces to force the cover and base away from each other.

2. The container of claim 1 wherein the base, cover and release tabs are formed of plastic material and wherein the cover has a top wall and side walls extending therefrom which are integrally connected together and wherein the base has a bottom wall and side walls extending therefrom which are integrally connected together.

3. The container of claim 1 wherein the base and cover are formed of plastic material and wherein the base has an outwardly overturned rim forming a peripheral shoulder and a flange extending outwardly therefrom, and wherein the release tab on the base extends from the flange.

4. The container of claim 1 wherein the cover, base and release tabs are formed of a plastic material and wherein one of the release tabs is attached to the periphery of one of the cover or base by a line of weakness to form a hinge such that the one tab rotates about the line of weakness when the camming surfaces engage.

5. The container of claim 4 wherein the line of weakness defining the hinge is formed of a plastic material which is integral with but thinner than the plastic material adjacent to the line of weakness.

6. The container of claim 1 wherein the cover, base and release tabs are integrally formed of sheet plastic material and the cover is hingedly attached at a peripheral edge to the base, wherein one of the tabs is attached to the periphery of one of the cover or base by line of weakness defining a hinge such that the one tab rotates about the hinge line of weakness when the camming surfaces engage, and wherein the hinge between the cover and base and the hinge by which the one tab is attached to one of the cover or base are formed of plastic material which is thinner than the plastic material adjacent to the hinges.

7. The container of claim 1 wherein the cover and base have means thereon for releasably interlocking the base to the cover when the cover is closed on the base, the means located in proximity to the release tabs on the base and cover.

8. The container of claim 7 wherein the means for releasably interlocking the base to the cover includes an overhanging lip formed on one of the base or cover along the periphery thereof and a mating indentation formed on the other of the base or cover adapted to mate with and engage the lip.

9. The container of claim 1 wherein the cover and base have corners therein and wherein the release tabs are joined to the cover and base along joint lines which lie along a diagonal across a corner of the cover and base.

10. The container of claim 1 wherein each of the release tabs has a raised reinforcing ridge formed therein which extends a substantial portion of the width of the tab, and wherein the camming surface is formed as a ridge extending toward the other tab when the cover is closed on the base and in a direction opposite to the direction in which the reinforcing ridge is raised.

11. The container of claim 10 wherein the reinforcing ridge in each tab surrounds the camming surface on at least three sides.

12. The container of claim 1 wherein the cover, base and release tabs are integrally formed of a plastic material selected from the group consisting of polystyrene, acrylic copolymer, polyvinylchloride, ABS, and polyester.

13. A reclosable container comprising:
(a) a base having a periphery;
(b) a cover having a periphery and hingedly connected at its periphery to the base to close upon and cover the same;
(c) a release tab extending from the periphery of the base;
(d) a release tab extending from the periphery of the cover at a position such that the tab on the cover lies adjacent to the tab on the base when the cover is closed on the base;
(e) means on the cover and base for releasably interlocking the base to the cover when the cover is closed on the base;
(f) camming means on the release tabs for engaging to form a fulcrum when the tabs are pressed toward one another when the cover is closed on the base such that the tabs apply force to the cover and base to draw the same apart.

14. The container of claim 13 wherein the base, cover and release tabs are formed of plastic material and wherein the cover has a top wall and side walls extending therefrom which are integrally connected together and wherein the base has a bottom wall and side walls extending therefrom which are integrally connected together.

15. The container of claim 13 wherein the base and cover are formed of plastic material and wherein the base has an outwardly overturned rim forming a peripheral shoulder and a flange extending outwardly therefrom, and wherein the release tab on the base extends from the flange.

16. The container of claim 13 wherein the cover, base and release tabs are formed of a plastic material and wherein one of the release tabs is attached to the periphery of one of the cover or base by a line of weakness to form a hinge such that the one tab rotates about the line of weakness when the camming surfaces engage.

17. The container of claim 16 wherein the line of weakness defining the hinge is formed of a plastic material which is integral with but thinner than the plastic material adjacent to the line of weakness.

18. The container of claim 13 wherein the cover, base and release tabs are integrally formed of sheet plastic material, wherein one of the tabs is attached to the periphery of one of the cover or base by line of weakness defining a hinge such that the one tab rotates about the hinge line of weakness when the camming surfaces engage, and wherein the hinge between the cover and base and the hinge by which the one tab is attached to one of the cover or base are formed of plastic material which is thinner than the plastic material adjacent to the hinges.

19. The container of claim 13 wherein the means for releasably interlocking the base to the cover includes an overhanging lip formed on one of the base or cover along the periphery thereof and a mating indentation formed on the other of the base or cover adapted to mate with and engage the lip, the overhanging lip and mating indentation located in proximity to the release tabs.

20. The container of claim 13 wherein the cover and base have corners therein and wherein the release tabs are joined to the cover and base along joint lines which lie along diagonals across a corner of the cover and base.

21. The container of claim 13 wherein each of the release tabs has a raised reinforcing ridge formed therein which extends a substantial portion of the width of the tab, and wherein the camming means on each tab is formed as a ridge extending toward the other tab when the cover is closed on the base and in a direction opposite to the direction in which the reinforcing ridge is raised.

22. The container of claim 21 wherein the reinforcing ridge on each tab surrounds the camming means on at least three sides.

23. The container of claim 13 wherein the cover, base and release tabs are integrally formed of a plastic material selected from the group consisting of polystyrene, acrylic polymer, polyvinylchloride, ABS, and polyester.

24. A reclosable plastic container, comprising:

(a) a base of plastic material having a bottom wall and upright side walls integrally connected together and to the bottom wall and having peripheral edges;

(b) a cover of plastic material having a top wall and side walls integrally connected together and to the top wall and having peripheral edges, the cover hingedly attached along a peripheral edge to the base to close upon and cover the same;

(c) a release tab integrally formed with and extending from a peripheral edge of the base and having a camming surface formed therein;

(d) a release tab integrally formed with and extending from a peripheral edge of the cover and having a camming surface formed therein which extends toward the camming surface on the release tab on the base when the cover is closed on the base, the camming surfaces engaging one another when the cover and base are closed and the tabs are pressed toward each other such that the tabs rotate about the position of contact of the camming surfaces to force the edges of the cover and base at the tabs away from each other;

(e) means on the cover and base for releasably interlocking the base to the cover when the cover is closed on the base.

25. The container of claim 24 wherein the base has an outwardly overturned rim forming a peripheral shoulder and a flange extending outwardly therefrom, and wherein the release tab on the base extends from the flange.

26. The container of claim 24 wherein the cover, base and release tabs are formed of a plastic material and wherein one of the release tabs is attached to the periphery of one of the cover or base by a line of weakness to form a hinge such that the one tab rotates about the line of weakness when the camming surfaces engage.

27. The container of claim 25 wherein the line of weakness defining the hinge is formed of a plastic material which is integral with but thinner than the plastic material adjacent to the line of weakness.

28. The container of claim 24 wherein the cover, base and release tabs are integrally formed of sheet plastic material, wherein one of the tabs is attached to the periphery of one of the cover or base by line of weakness defining a hinge such that the one tab rotates about the hinge line of weakness when the camming surfaces engage, and wherein the hinge between the cover and base and the hinge by which the one tab is attached to one of the cover or base are formed of plastic material which is thinner than the plastic material adjacent to the hinges.

29. The container of claim 24 wherein the means for releasably interlocking the base to the cover includes an overhanging lip formed on one of the base or cover along the periphery thereof and a mating indentation formed on the other of the base or cover adapted to mate with and engage the lip, the overhanging lip and mating indentation located in proximity to the release tabs.

30. The container of claim 24 wherein the cover and base have corners therein and wherein the release tabs are joined to the cover and base along joint lines which lie along diagonals across a corner of the cover and base.

31. The container of claim 25 wherein each of the release tabs has a raised reinforcing ridge formed therein which extends a substantial portion of the width of the tab, and wherein the camming surface is formed as a ridge extending toward the other tab when the cover is closed on the base and in a direction opposite to the direction in which the reinforcing ridge is raised.

32. The container of claim 24 wherein the reinforcing ridge in each tab surrounds the camming surface on at least three sides.

33. The container of claim 24 wherein the cover, base and release tabs are integrally formed of a plastic material selected from the group consisting of polystyrene, acrylic copolymer, polyvinylchloride, ABS, and polyester.

* * * * *